US007948736B2

(12) United States Patent
Liu et al.

(10) Patent No.: US 7,948,736 B2
(45) Date of Patent: May 24, 2011

(54) BALANCE TRANSFORMER AND BACKLIGHT APPARATUS

(75) Inventors: Ming Feng Liu, Taoyuan County (TW); Chao Jung Lin, Bade (TW)

(73) Assignee: Darfon Electronics Corp., Gueishan, Taoyuan (TW)

( * ) Notice: Subject to any disclaimer, the term of this patent is extended or adjusted under 35 U.S.C. 154(b) by 458 days.

(21) Appl. No.: 12/207,772

(22) Filed: Sep. 10, 2008

(65) Prior Publication Data

US 2009/0160350 A1 Jun. 25, 2009

(30) Foreign Application Priority Data

Dec. 25, 2007 (TW) ..... 96149828 A

(51) Int. Cl.
*H01H 9/28* (2006.01)
*H01F 21/02* (2006.01)
*H05B 41/14* (2006.01)

(52) U.S. Cl. ..... 361/268; 336/145; 315/282; 315/281

(58) Field of Classification Search ..... 315/276, 315/277, 278, 279, 280, 281, 282, 283, 284, 315/285, 286, 312, 185 R; 336/180, 182, 336/184, 145, 146, 147, 149; 361/268
See application file for complete search history.

(56) References Cited

U.S. PATENT DOCUMENTS

| | | | | |
|---|---|---|---|---|
| 5,936,359 | A * | 8/1999 | Gibson | 315/276 |
| 7,075,244 | B2 * | 7/2006 | Kang et al. | 315/212 |
| 7,362,598 | B2 * | 4/2008 | Schaible et al. | 363/89 |
| 7,525,258 | B2 * | 4/2009 | Kim et al. | 315/282 |

FOREIGN PATENT DOCUMENTS

| | | | |
|---|---|---|---|
| JP | H935690 | A | 2/1997 |
| KR | 1020040030260 | A | 4/2004 |
| KR | 1020070052393 | A | 5/2007 |
| KR | 100780181 | B1 | 11/2007 |

* cited by examiner

*Primary Examiner* — Douglas W Owens
*Assistant Examiner* — Minh D A
(74) *Attorney, Agent, or Firm* — Winston Hsu; Scott Margo

(57) ABSTRACT

The invention provides a balance transformer and a backlight apparatus using the same. The balance transformer comprises a first main coil, a second main coil, a first induction coil, and a conductor. The first main coil has a first contact point and a second contact point, and the second main coil has a third contact point and a fourth contact point. The first induction coil is corresponding to the first main coil and the second main coil. The conductor is then series connected to the first contact point and the fourth contact point. Accordingly, the balance transformer drives the backlight apparatus to light and balances the currents of a plurality of light units of the backlight apparatus.

16 Claims, 6 Drawing Sheets

BALANCE TRANSFORMER AND BACKLIGHT APPARATUS

CROSS-REFERENCE TO RELATED APPLICATIONS

This non-provisional application claims priority under 35 U.S.C. §119(a) on Patent Application No(s). 096149828 filed in Taiwan, R.O.C. on Dec. 25, 2007, the entire contents of which are hereby incorporated by reference.

BACKGROUND OF THE INVENTION

1. Field of the Invention

This invention relates to a balance transformer and a backlight apparatus using the same, and more particularly, the invention relates to a balance transformer capable of driving a plurality of lighting units and a backlight apparatus using the same.

2. Description of the Prior Art

With the increase in the size of Liquid Crystal Display (LCD) panel, the backlight apparatus with a plurality of Cold Cathode Fluorescent Lamps (CCFLs) has been commonly used as the light source of the LCD panel.

Multi-lamp backlight apparatus is facing a critical issue: how the currents of the lamps can be kept substantially equal with each other to ensure that the light source that provides the LCD panel has stable and uniform illumination.

To solve the problem mentioned above, a Jin balance circuit for multi-lamp backlight apparatus was applied. Please refer to FIG. 1. FIG. 1 is a schematic diagram illustrating a backlight apparatus 1 with Jin balance circuit in the prior art. As shown in FIG. 1, the backlight apparatus 1 comprises ten lighting units 12. A balance transformer 10 is series connected to one lighting unit 12 in the Jin balance circuit, so the backlight apparatus 1 needs ten balance transformers 10 to ensure that the currents of the lighting units 12 are equal.

The increase in the size of LCD panel means that the required number of the lamps increases, and if the Jin balance circuit is used for balancing the currents flow through the lamps, the corresponding number of the transformers is also required. Besides, the size of the Printed Circuit Board (PCB) must be increased with the increase in the number of the balance transformers.

On the other hand, two polarities source is needed for driving the above-mentioned Jin balance circuit, however, a problem of isolating distance between two polarities lines arises with the present Jin balance circuit. The traditional solution discloses double-layer PCB and high-voltage jumpers for the increase in the isolating distance.

As described above, the increase in the number of the balance transformers, the increase in the size of the PCB, the increase in the number of the high-voltage jumpers, and the use of the double layers PCB will cause the cost of the backlight apparatus to arise.

SUMMARY OF THE INVENTION

A scope of the invention is to provide a balance transformer for driving and balancing the lighting units of the backlight apparatus to solve the above-mentioned problems.

According to an embodiment, the balance transformer of the invention comprises a first main coil, a second main coil, a first induction coil, and a conductor, wherein the coil numbers of the first main coil, the second main coil, and the first induction coil are substantially equal to each other. The first main coil has a first contact point and a second contact point, and the second main coil has a third contact point and a fourth contact point. The first induction coil is corresponding to the first main coil and the second main coil. The conductor is series connected to the first contact point of the first main coil and the four contact coil of the second main coil.

According to another embodiment, the first contact point of the first main coil of the balance transformer of the invention could be electrically connected to a single polarity high-voltage power source, and the single polarity high-voltage power could be conducted to the fourth contact point through the conductor. The second contact point and the third contact point could be electrically connected to the lighting units of the backlight module respectively. Accordingly, the balance transformer can drive the lighting units, and because the coil number of the first induction coil is substantially equal to those of the first main coil and the second main coil, the balance transformer can balance the lighting units. Besides, the first induction coil could further be electrically connected to a feedback control circuit.

Another scope of the invention is to provide a backlight apparatus using novel balance transformers to balance the currents of the lighting units.

According to an embodiment, the backlight apparatus comprises 2N lamps and N balance transformers, wherein N is a positive integer.

In this embodiment, the N balance transformers are electrically connected to the 2N lamps. The kth balance transformer of the N balance transformers comprises a first main coil, a second main coil, a first induction coil, and a conductor, wherein k is a positive integer in the range from 1 to N. The first main coil has a first contact point and a second contact point, and the second contact point has a third contact point and a fourth contact point. The first induction coil is corresponding to the first main coil and the second main coil, and the coil number of the first induction coil is substantially equal to those of the first main coil and the second main coil. The conductor is series connected to the first contact point of the first main coil and the fourth contact point of the second main coil.

The second contact point of the first main coil of the kth balance transformer could be series connected to the (2k−1)th lamp of the 2N lamp, and the third contact point of the second main coil of the kth balance transformer could be series connected to the 2kth lamp of the 2N lamps. Besides, the fourth contact point of the second main coil of the kth balance transformer could be series connected to the first contact point of the (k+1)th balance transformer of the N balance transformers. Accordingly, the N balance transformers can drive 2N lighting units, and because the coil number of each of the first induction coils is substantially equal to each of the first main coils and each of the second main coils, the N balance transformers can balance the 2N lighting units. Furthermore, all of the induction coils of the N balance transformer could be series connected to each other to form a loop, and the loop could further be electrically connected to a feedback control circuit.

According to another embodiment, the backlight module of the invention further comprises a second induction coil besides the parts in the above-mentioned embodiment. The second induction coil could be electrically connected to a protecting circuit. By the protecting circuit, the balance transformers could be prevented from the irregular operation.

According to another embodiment, the backlight module of the invention further comprises 2N high-voltage capacitances series connected to the 2N lamps respectively besides the parts in the above-mentioned embodiment. Furthermore, the first contact point of the first balance transformer of the N balance transformer could be electrically connected to a single polarity high-voltage power source.

The advantage and spirit of the invention may be understood by the following recitations together with the appended drawings.

BRIEF DESCRIPTION OF THE APPENDED DRAWINGS

DETAILED DESCRIPTION OF THE INVENTION

Figure 1:
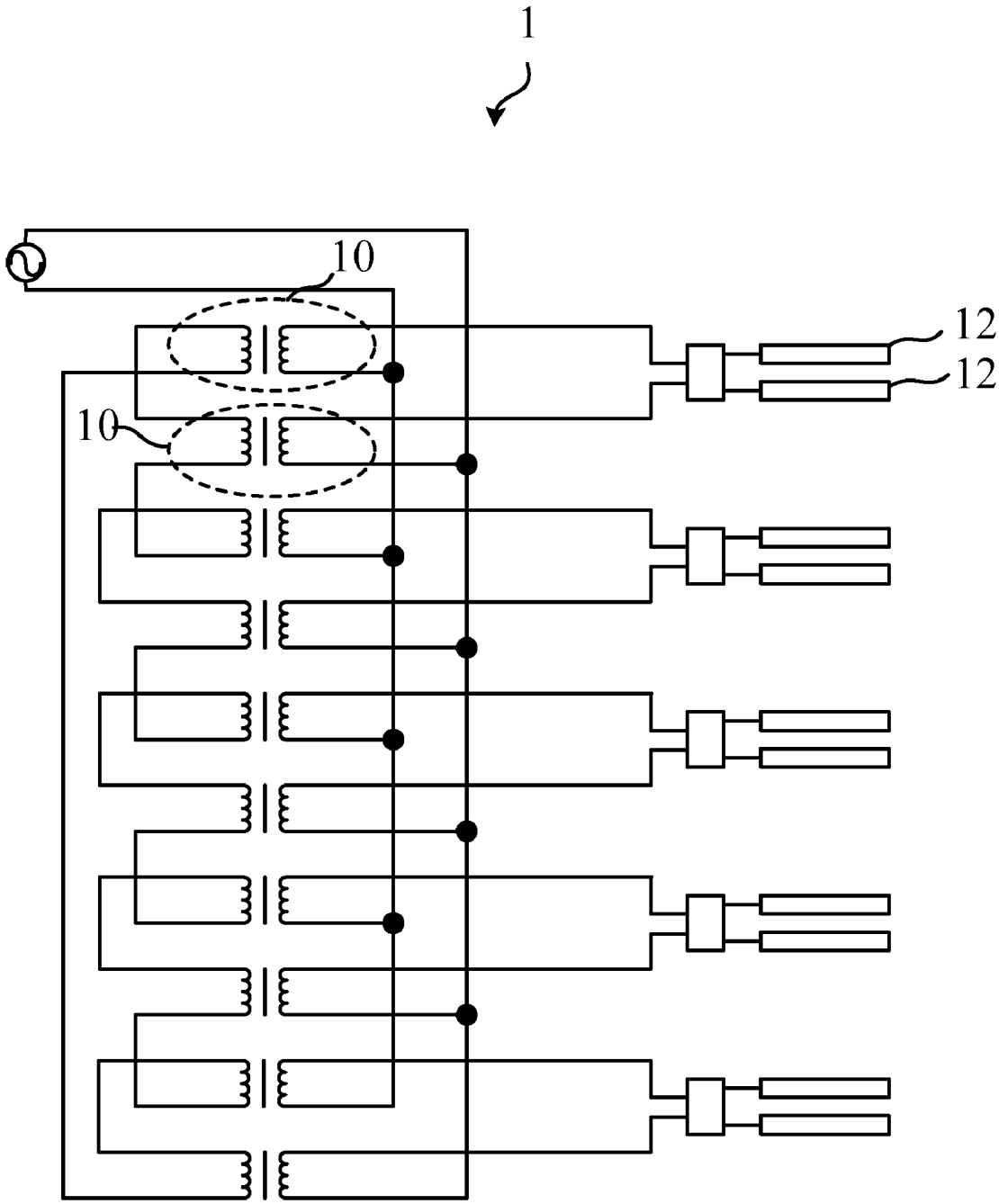
FIG. 1 (Prior Art)
FIG. 1 is a schematic diagram illustrating a backlight apparatus with a Jin balance circuit in the prior art.
Figure 2A:
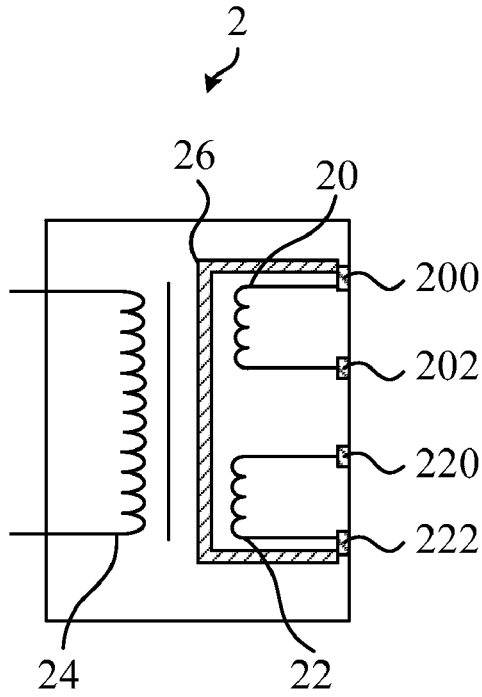
FIG. 2A is an internal structure diagram illustrating the internal structure of a balance transformer according to an embodiment of the invention.

Please refer to FIG. 2A. FIG. 2A is an internal structure diagram illustrating the internal structure of a balance transformer 2 according to an embodiment of the invention. As shown in FIG. 2A, the balance transformer 2 comprises a first main coil 20, a second main coil 22, a first induction coil 24, and a conductor 26.

In this embodiment, the first main coil 20 comprises a first contact point 200 and a second contact point 202, and the second main coil 22 comprises a third contact point 220 and a fourth contact point 222. The first induction coil 24 is corresponding to the first main coil 20 and the second main coil 22. The conductor 26 is series connected to the first contact point 202 and the fourth contact point 222, so that a power source can provide power to the fourth contact point 222 through the conductor 26 when the first contact point 202 is electrically connected to the power source.

Furthermore, in the same balance transformer 2, the coil numbers of the first main coil 20, the second main coil 22, and the first induction coil 24 could be, but not limited to, substantially equal to each other.

Figure 2B:
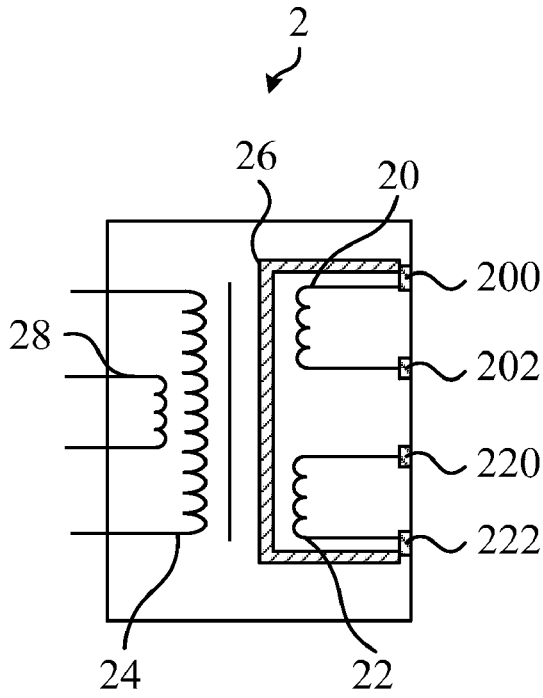
FIG. 2B is an internal structure diagram illustrating the internal structure of a balance transformer according to another embodiment of the invention.

Please refer to FIG. 2B. FIG. 2B is an internal structure diagram illustrating the internal structure of a balance transformer 2 according to another embodiment of the invention. As shown in FIG. 2B, the difference between this embodiment and the last embodiment is that the balance transformer 2 in this embodiment further comprises a second induction coil 28. It should be noted that, in practice, the second induction coil 28 could be formed by pulling out two contact points from the first induction coil 24. Besides, the other parts of the balance transformer 2 in this embodiment are the same with the corresponding parts in the last embodiment, which would not be described here.

Figure 3:
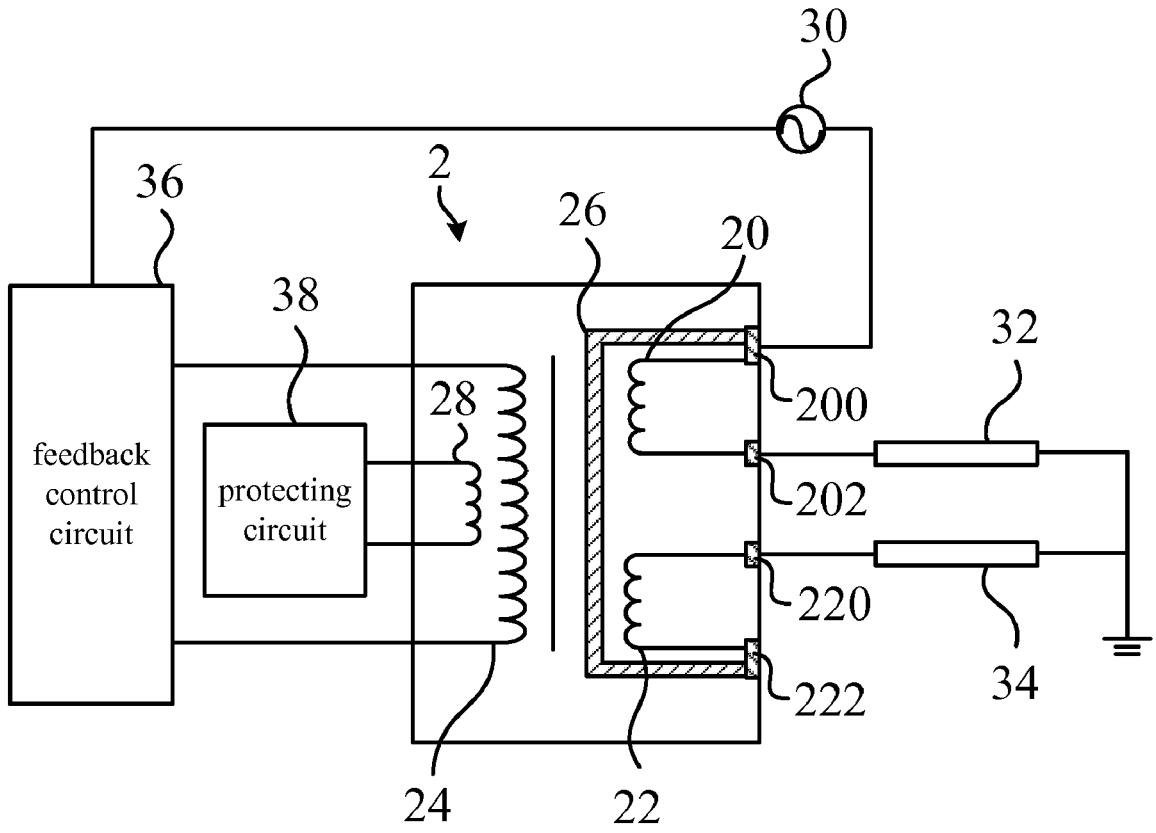
FIG. 3 is a schematic diagram illustrating that the balance transformer in FIG. 2B forms a balance circuit.

Please refer to FIG. 3. FIG. 3 is a schematic diagram illustrating that the balance transformer 2 in FIG. 2B forms a balance circuit. As shown in FIG. 3, the first contact point 200 of the balance transformer 2 is electrically connected to a single polarity high-voltage power source 30; the second contact point 202 is electrically connected to a first lighting unit 32; and the third contact point 220 is electrically connected to a second lighting unit 34. Through the single polarity high-voltage power source 30, the first main coil 20, the second main coil 22, and the conductor 26, the first lighting unit 32 and the second lighting unit 34 could be driven to light.

In this embodiment, because the coil numbers of the first main coil 20, the second main coil 22, and the first induction coil 24 are substantially equal to each other, the current provided to the first lighting unit 32 would be substantially equal the current provided to the second lighting unit 34, according to the law of conversation of energy. Besides, the first induction coil 24 is electrically connected to a feedback control circuit 36, and the feedback control circuit 36 can adjust the power provided by the single high-voltage source 30 according to the currents of the first lighting unit 32 and the second light unit 34 induced by the first induction coil 24, so that the currents of the first lighting unit 32 and the second unit 34 match the value which is set by the designer or the user.

Furthermore, the second induction coil 28 in the embodiment is electrically connected to the protecting circuit 38, and through the protecting circuit 38, the balance transformer 2 could avoid irregular operation, so as to protect the balance of transformer 2. For example, the second induction coil 28 induces the variation of the current of the first main coil 20 and the protecting circuit 38 selectively stops the balance transformer 2 or the single polarity high-voltage power source 30 according to the result induced by the second induction coil 28 when the first lighting unit 32 or the lighting unit 34 is damaged and forms the open circuit.

In practice, the differences of the resistances among each part of the balance circuit in the above-mentioned embodiment would form the deviations among the currents flowing through the lighting units. It should be noted that the magnitude of the deviations are determined according to the resistances of the first main coil, the second main coil, the conductor, the lighting unit, or the other parts in the balance circuit, but not at a fixed value. To improve on this phenomenon, a side of the lighting unit could be series connected to a high-voltage capacitance with small capacity, so that the differences of the resistances among the first main coil, the second main coil, the conductor, the lighting unit, or the other parts in the balance circuit could be ignored to obtain stable and uniform lamp currents.

Figure 4A:
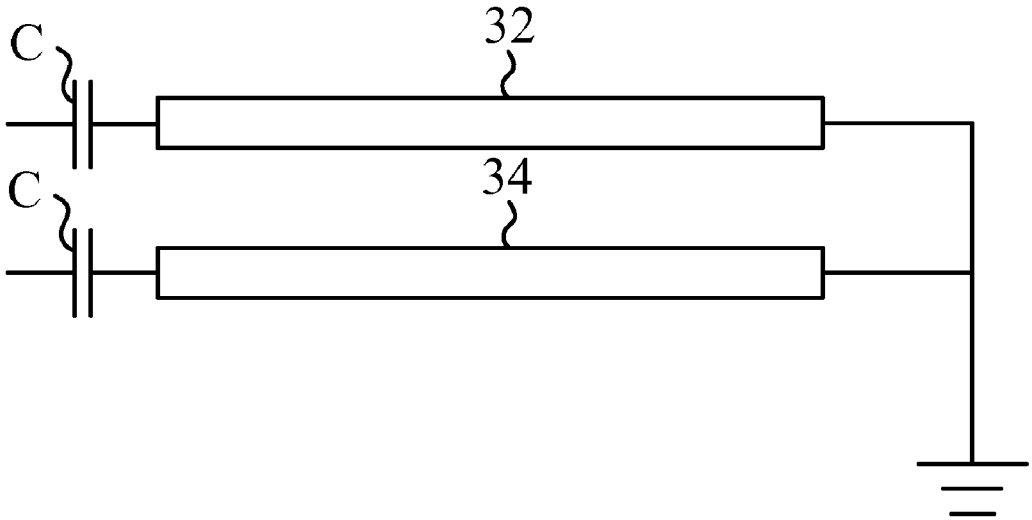
FIG. 4A and FIG. 4B are schematic diagrams illustrating that the lighting units in FIG. 3 are connected to high-voltage capacitances.
Figure 4B:
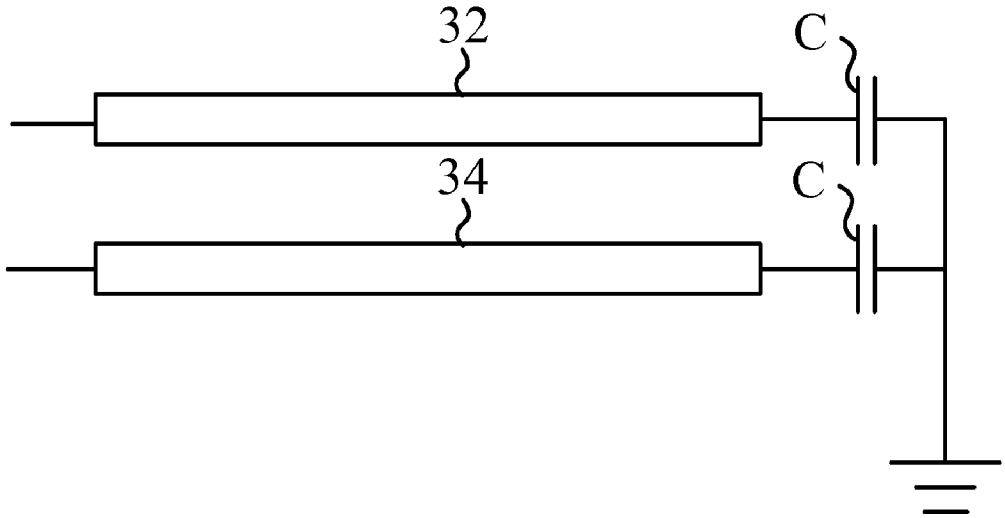

Please refer to FIG. 4A and FIG. 4B. FIG. 4A and FIG. 4B are schematic diagrams illustrating that the lighting units in FIG. 3 are series connected to high-voltage capacitances C. As shown in FIG. 4A, the high-voltage capacitances C with small capacity are series connected to the high voltage terminals of the first lighting unit 32 and the second lighting unit 34, i.e., between the balance transformer and the lighting unit. On the other hand, as shown in FIG. 4B, the high-voltage capacitances C could be series connected to the low voltage terminals of the first lighting unit 32 and the lighting unit 34.

Figure 5:
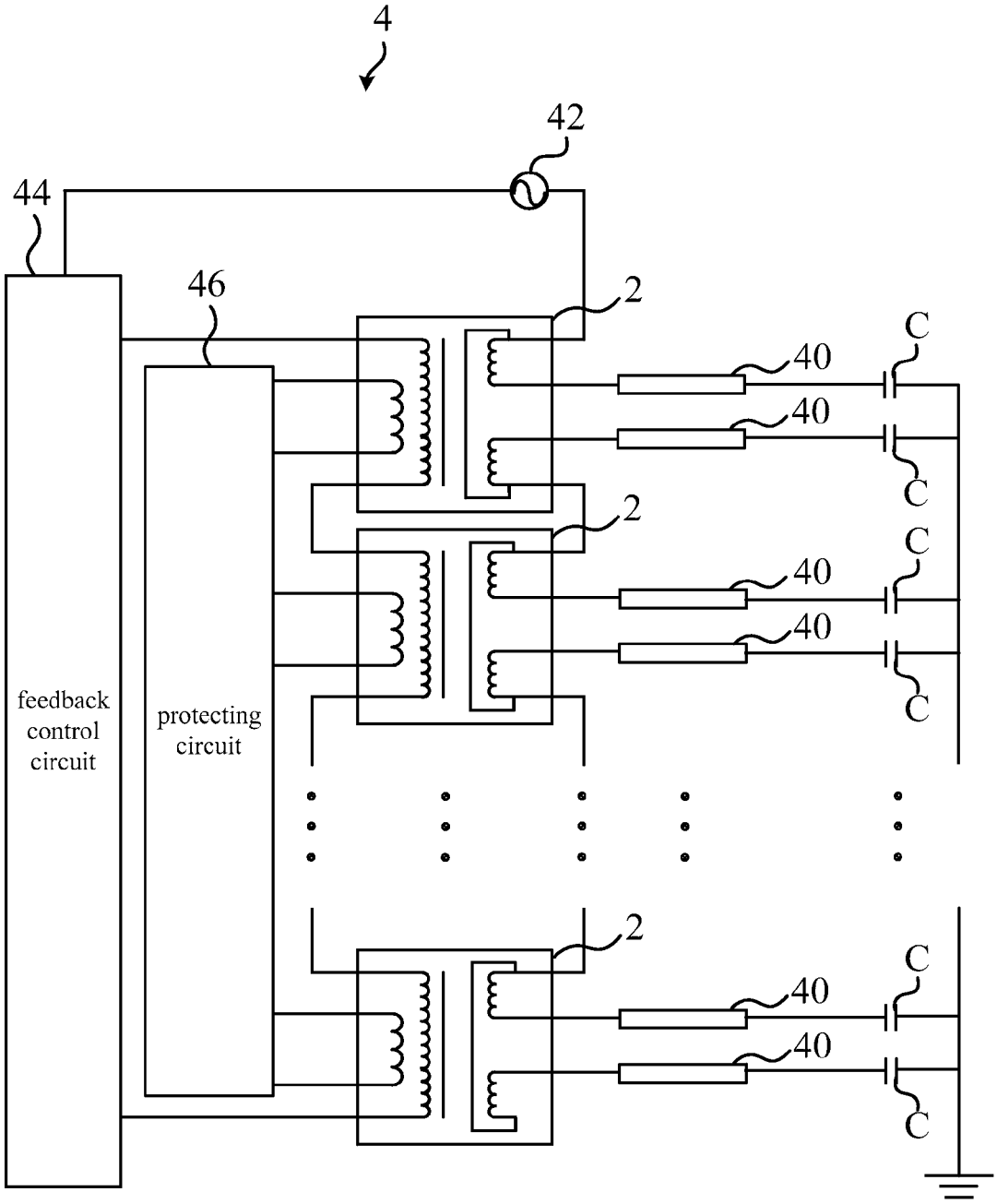
FIG. 5 is a schematic diagram illustrating a backlight apparatus according to an embodiment of the invention.

Please refer to FIG. 5 and FIG. 2B. FIG. 5 is a schematic diagram illustrating a backlight apparatus 4 according to an embodiment of the invention. As shown in FIG. 5, the backlight apparatus 4 comprises N balance transformers 2, 2N lighting units 40, a single polarity high-voltage power source 42, a feedback control circuit 44, and a protecting circuit 46, wherein N is a positive integer. The internal structure of each of the balance transformers 2 is shown in FIG. 2B. It should be noted that the function of each part of the balance transformers 2 is the same with that of the corresponding part in the above-mentioned embodiment, and those would not described here.

In this embodiment, the second contact point 202 of the kth balance transformer 2 of the N balance transformers 2 is series connected to the (2k−1)th lighting unit 40 of the 2N lighting units 40, and the third contact point 220 is series connected to the 2kth lighting unit 40, wherein k is a positive integer in the range from 1 to N. The fourth contact point 222 of the kth balance transformer 2 is series connected to the first contact point 200 of the (k+1)th balance transformer 2. Therefore, all of the first contact points 200 and the fourth contact points 222 could be connected to each other through the conductor 26 of each of the balance transformers 2.

In this embodiment, the first contact point 200 of the first balance transformer 2 of the N balance transformers 2 is electrically connected to the single polarity high-voltage power source 42. The conductors 26 are series connected to the first contact points 200 and the fourth contact points 222, so the single polarity high-voltage power source 42 can provide power to each of the first contact points 200 and the fourth contact points 222. The N lighting units 40 could be driven to light through the single polarity high-voltage power source 42, each of the first main coils 20, and each of the second main coils 22. In practice, because the balance transformer 2 therein series connects the first contact point 200 and the fourth contact point 222 through the conductor 26, the high-voltage jumper could be avoided in the circuit configuration of the backlight apparatus 4.

The coil numbers the first main coils 20, the second main coils 22, and the first induction coils 24 are substantially equal to each other, so that the currents provided to the lighting units 40 are substantially equal to each other according to the law of conversation of energy. Besides, the first induction coils 24 are series connected to each other to form a loop, and the loop could be further and series connected to the feedback control circuit 44. The feedback control circuit 44 can adjust power provided by the single high-voltage source 30 according to the currents of the lighting units 40 induced by the first induction coils 24, so that the currents of the lighting unit 40 can reach the value which is set by the designer or the user.

Furthermore, each of the second induction coils 28 in this embodiment is electrically connected to the protecting circuit 46, and through the protecting circuit 46, the balance transformers 2 could be prevented from the irregular operation to protect the balance transformers 2. For example, the second induction coil 28 of the kth balance transformer 2 induces the variation of the first main coil 20 and the protecting circuit 46 selectively stops the kth balance transformer 2, all the balance transformers 2, or the single polarity high-voltage power source 30 according to the result induced by the second induction coil 28 when the (2k+1)th lighting unit 40 is damaged and forms the open circuit.

Similarly, the backlight apparatus 4 can comprise high-voltage capacitances C, with small capacity, series connected to the lighting units 40 respectively. In this embodiment, the high-voltage capacitances C are series connected to the low voltage terminals of the lighting units 40 respectively; however, in practice, the high-voltage capacitances C could be series connected to the high voltage terminals of the lighting units 40 respectively, i.e., between each of the balance transformers 2 and each of the lighting units 40. It should be noted that the high-voltage capacitances C are not necessary for the backlight apparatus 4 in practice, and the existence of the high-voltage capacitances C is determined if the deviations of the currents of the lighting units 40, caused by the differences of the resistances between each part of the backlight apparatus 4, are too large. For example, if the deviation of the currents of any two lighting units overtakes 5% and the designer judges that the user could easily recognize the imbalance between the two lighting units in this condition, the high-voltage capacitances C could be series connected to the lighting units respectively to improve the deviation of the currents between the two lighting units.

Figure 6:
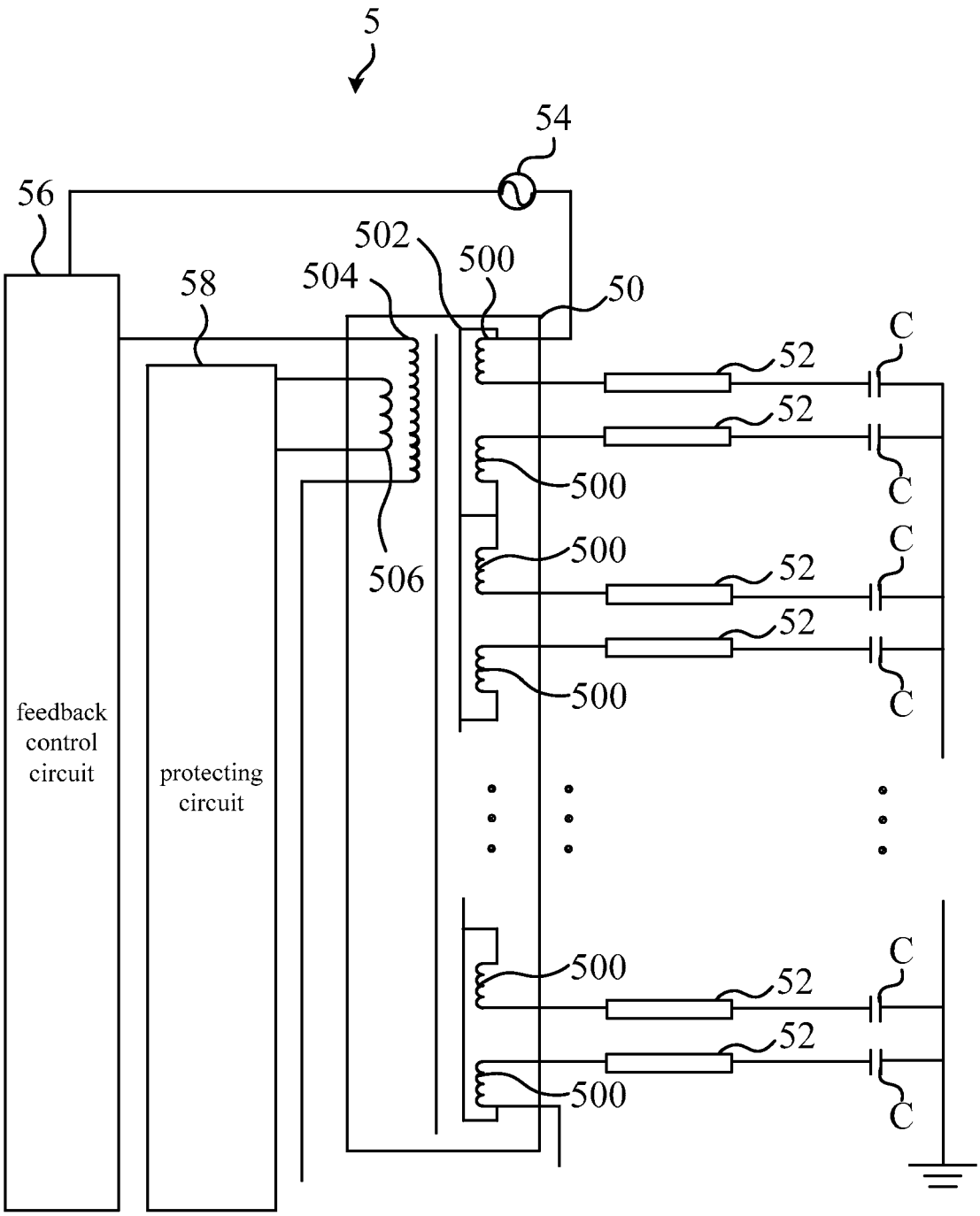
FIG. 6 is a schematic diagram illustrating a backlight apparatus according to another embodiment of the invention.

Please refer to FIG. 6. FIG. 6 is a schematic diagram illustrating a backlight apparatus 5 according to another embodiment of the invention. As shown in FIG. 6, the difference between this embodiment and the above-mentioned embodiment is that the backlight apparatus 5 in this embodiment comprises M balance transformers 50, and each of the M balance transformers 50 further comprises N main coil 500, wherein M and N are positive integers. To make the figure neat and clean, only one balance transformer 50 is illustrated in FIG. 6.

In this embodiment, one contact point of each of the main coils 500 is series connected to one of the N lighting units 52 respectively, and another contact point of each of the main coils 500 is connected to each other. Therefore, a balance transformer 50 can drive N lighting units. Similarly, the balance transformer 50 comprises the first induction coil 504 and the second induction coil 506, wherein the coil number of the first induction coil 504 is substantially equal to the coil number of each of the main coil 500; the first main coil 500 of the first balance transformer 50 is electrically connected to a single polarity high-voltage power source 54, and the Nth main coil 500 of the kth balance transformer 50 is connected to the first main coil 500 of the (k+1)th balance transformer 50, so that all the balance transformers 50 can receive the power provided by the single polarity high-voltage power source 54 to drive the lighting units, wherein k is a positive integer in the range from 1 to M; the first induction coils 504 of the M balance transformers 50 of the backlight 5 are series connected to each other to form a loop (not shown in the figure), and the loop is further and series connected to the feedback control circuit 56; the second induction coils 506 are electrically connected to the protecting circuit 58; the lighting units 52 are series connected to the high-voltage capacitances C respectively. The functions of these parts are the same with the functions of the corresponding parts in the above-mentioned embodiment, and they would not be described here.

Compared to the prior art, the balance transformer and the backlight apparatus using the same of the invention can drive two or more lighting units and balance the currents flowing through the lighting units by one balance transformer. Furthermore, because the balance transformer has a conductor series connected to each of the main coils, the high-voltage jumper could be avoided. Besides, a single polarity power source could be used as the driving source of the backlight apparatus according to the structure of the balance transformer to avoid the problem of isolating distance, so that the single layer PCB could be applied. As shown in the above-mentioned descriptions, the balance transformer and the backlight apparatus using the same of the invention can decrease the cost effectively.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A balance transformer, comprising:

a first main coil with a first contact point and a second contact point;

a second main coil with a third contact point and a fourth contact point;

a first induction coil corresponding to the first main coil and the second main coil; and a conductor is connected to the first contact point of the first main coil and the fourth contact point of the second main coil in series, wherein the second contact point is electrically connected to a first lighting unit of a backlight apparatus, and the third contact point is electrically connected to a second light unit of the backlight apparatus.

2. The balance transformer of claim 1, wherein the first contacting point of the first main coil is electrically connected to a high-voltage power source.

3. The balance transformer of claim 2, wherein the high-voltage power source is a single polarity high-voltage power source.

4. The balance transformer of claim 1, wherein the coil numbers of the first main coil, the second main coil, and the first induction coil are substantially equaled to each other.

5. The balance transformer of claim 1, wherein the first induction coil further comprises a second induction coil.

6. The balance transformer of claim 5, wherein the second induction coil is electrically connected to a protecting circuit.

7. The balance transformer of claim 1, wherein the first lighting unit and the second lighting unit are respectively and series connected to a high-voltage capacitance.

8. The balance transformer of claim 7, wherein the high-voltage capacitances are respectively and series connected between the first lighting unit and the second contact point, and between the second lighting unit and the third contact point.

9. A backlight apparatus, comprising:

2N lamps, N being a positive integer; and

N balance transformers, electrically connected to the 2N lamps, k being a positive integer in the range from 1 to N and the kth balance transformer comprising:

a first main coil with a first contact point and a second contact point, the second contact point being series connected to the (2k−1)th lamp of the 2N lamps;

a second main coil with a third contact point and a fourth contact point, the third contact point being series connected to the 2kth lamp of the 2N lamps, and the fourth contact point being series connected to the first contact point of the (k+1)th balance transformer of the N balance transformer;

a first induction coil corresponding to the first main coil and the second main coil, the N first induction coils of the N balance transformers being series connected to each other to form a loop; and a conductor is connected to the first contact point and the fourth contact point in series.

10. The backlight apparatus of claim 9, further comprising:

a single polarity high-voltage power source, electrically connected to the first balance transformer of the N balance transformers.

11. The backlight apparatus of claim 9, wherein the coil numbers of the first main coil, the second main coil, and the first induction coil are substantially equal to each other.

12. The backlight apparatus of claim 9, wherein each of the first induction coils further comprises a second induction coil.

13. The backlight apparatus of claim 9, wherein the second induction coil is electrically connected to a protecting circuit.

14. The backlight apparatus of claim 9, wherein the loop, formed from the N first induction coils which are series connected to each other, is further series connected to a feedback control circuit.

15. The backlight apparatus of claim 9, wherein each of the lamps is series connected to a high-voltage capacitance.

16. The backlight apparatus of claim 15, wherein the high-voltage capacitances are respectively and series connected among all of the lamps and the corresponding first main coil, or among all of the lamps and the corresponding second main coil.

* * * * *